US005551960A

United States Patent [19]

Christianson

[11] Patent Number: 5,551,960

[45] Date of Patent: Sep. 3, 1996

[54] ARTICLE FOR POLISHING STONE

[75] Inventor: Todd J. Christianson, Oakdale, Minn.

[73] Assignee: Minnesota Mining and Manufacturing Company, St. Paul, Minn.

[21] Appl. No.: 441,426

[22] Filed: May 15, 1995

Related U.S. Application Data

[62] Division of Ser. No. 436,891, May 8, 1995, abandoned, which is a continuation of Ser. No. 30,787, Mar. 12, 1993, abandoned.

[51] Int. Cl.[6] ..... B24D 3/02

[52] U.S. Cl. ..... 51/295; 51/298; 51/297

[58] Field of Search ..... 51/295, 297, 298

[56] References Cited

U.S. PATENT DOCUMENTS

| | | | |
|---|---|---|---|
| 2,115,897 | 5/1938 | Wooddell et al. | 451/529 |
| 2,907,146 | 10/1959 | Dyar | 51/195 |
| 3,048,482 | 8/1962 | Hurst | 51/298 |
| 3,098,329 | 7/1963 | Doran | 51/177 |
| 3,401,491 | 3/1965 | Schnabel et al. | 51/296 |
| 3,468,079 | 9/1969 | Kaufman | 51/378 |
| 3,517,466 | 6/1970 | Bouvier | 51/358 |
| 3,605,349 | 9/1971 | Anthon | 51/402 |
| 3,770,400 | 11/1973 | Hallewell | 51/295 |
| 4,047,903 | 9/1977 | Hesse et al. | 51/298 |
| 4,088,729 | 5/1978 | Sherman | 264/259 |
| 4,098,329 | 7/1978 | Culver | 165/140 |
| 4,106,915 | 8/1978 | Kagawa et al. | 51/96 |
| 4,111,666 | 9/1978 | Kalbow | 51/295 |
| 4,255,164 | 3/1981 | Butzke et al. | 51/295 |
| 4,311,489 | 1/1982 | Kressner | 51/298 |
| 4,317,660 | 3/1982 | Kramis et al. | 51/295 |
| 4,355,489 | 10/1982 | Heyer et al. | 51/400 |
| 4,457,766 | 7/1984 | Caul | 51/298 |
| 4,547,204 | 10/1985 | Caul | 51/298 |
| 4,588,419 | 5/1986 | Caul et al. | 51/295 |
| 4,617,767 | 10/1986 | Ali | 51/358 |
| 4,642,126 | 2/1987 | Zador et al. | 51/295 |
| 4,652,274 | 3/1987 | Boettcher et al. | 51/298 |
| 4,652,275 | 3/1987 | Bloecher et al. | 51/298 |
| 4,675,975 | 6/1987 | Kucharczyk et al. | 29/566 |
| 4,735,632 | 4/1988 | Ozman et al. | 51/295 |

(List continued on next page.)

FOREIGN PATENT DOCUMENTS 478427 9/1966 Belgium .

(List continued on next page.)

OTHER PUBLICATIONS

3M Product Literature No.: 60–4400–2429–1 (112.5) JR, "3M Flexible Diamond Discs" (1990).

*Coated Abrasives–Modern Tool of Industry,* 1st Ed., McGraw–Hill Book Company, Inc., (1958) pp. 333–334.

R. B. Seymour & C. E. Carraher, Jr., *Polymer Chemistry,* 2nd Ed (1988).

Cowie, J. M. G., "Polymers: Chemistry and Physics of Modern Materials" (1973).

*Primary Examiner*—Deborah Jones

*Attorney, Agent, or Firm*—Gary L. Griswold; Walter N. Kirn; Doreen S. L. Gwin

[57] ABSTRACT

In accordance with the present invention, a method of polishing stone and an article for use in the method are presented in which the stone has at least one exposed surface, the method comprising the steps of:

a) bringing into frictional contact an abrasive article to the exposed surface of the stone; and b) refining the exposed surface of the stone with the abrasive article, preferably in the presence of water, wherein the abrasive article comprises a plurality of abrasive particles adhered to a backing (preferably a flexible backing) by a binder (preferably a resilient binder), wherein the binder comprises a cured resin derived from a resin comprising unsaturated addition polymerizable units. The binder and abrasive particles (and plasticizer when used) form a resilient composite having a hardness no greater than 20 HK but at least 1 HK. Use of the articles and method of the invention efficiently increases the gloss of stone surfaces.

28 Claims, 3 Drawing Sheets

U.S. PATENT DOCUMENTS

| | | | |
|---|---|---|---|
| 4,750,915 | 6/1988 | Tomita et al. | 51/298 |
| 4,751,138 | 6/1988 | Tumey et al. | 428/323 |
| 4,754,580 | 7/1988 | Mattson | 51/177 |
| 4,773,920 | 9/1988 | Chasman et al. | 51/295 |
| 4,799,939 | 1/1989 | Bloecher et al. | 51/293 |
| 4,836,832 | 6/1989 | Tumey et al. | 51/293 |
| 4,898,598 | 2/1990 | Zapata | 51/309 |
| 4,903,440 | 2/1990 | Larson et al. | 51/298 |
| 4,930,266 | 6/1990 | Calhoun et al. | 51/293 |
| 4,945,687 | 8/1990 | Scheider et al. | 51/394 |
| 4,974,373 | 12/1990 | Kawashima et al. | 51/295 |
| 5,011,512 | 4/1991 | Wald et al. | 51/295 |
| 5,011,513 | 4/1991 | Zador et al. | 51/295 |
| 5,014,468 | 5/1991 | Ravipati et al. | 51/295 |
| 5,015,266 | 5/1991 | Yamamoto | 51/293 |
| 5,092,910 | 3/1992 | deKok et al. | 51/295 |
| 5,107,626 | 4/1992 | Mucci | 51/281 R |
| 5,152,917 | 10/1992 | Pieper et al. | 51/295 |
| 5,174,795 | 12/1992 | Wiand | 51/295 |
| 5,178,646 | 1/1993 | Barber, Jr. et al. | 51/299 |
| 5,213,588 | 5/1993 | Wong et al. | 51/298 |
| 5,216,846 | 6/1993 | Takahashi | 51/326 |
| 5,274,959 | 1/1994 | Dyer et al. | 51/103 R |

FOREIGN PATENT DOCUMENTS

| | | |
|---|---|---|
| 0004454 | 10/1979 | European Pat. Off. . |
| 0345239 | 12/1989 | European Pat. Off. . |
| 0434378A1 | 6/1991 | European Pat. Off. . |
| 52-74990 | 6/1977 | Japan . |
| 2043501 | 10/1980 | United Kingdom . |
| 2057484 | 4/1981 | United Kingdom . |
| 2094824 | 9/1982 | United Kingdom . |

ARTICLE FOR POLISHING STONE

This is a division of application Ser. No. 08/436,891, filed May 8, 1995, which is a continuation of Ser. No. 08/030,787, filed Mar. 12, 1993, now abandoned.

BACKGROUND OF THE INVENTION

1. Field of the Invention

This invention pertains to a method of polishing stone with an abrasive article. The abrasive article comprises a backing having a plurality of abrasive particles bonded to the backing by means of a resilient binder comprising an addition polymerized resin.

2. Related Art

Stone materials, like marble and granite, are widely used in buildings, monuments, homes, offices and the like. Stone materials can be synthetically made or quarried from natural deposits in the earth. In some instances it is desirable to have a very smooth or high gloss finish on the exposed surface of the stone. In order to achieve this high gloss, the stone is typically subjected to several steps. First, the stone is quarried or mined. Then it is cut to the desired length or dimensions, for instance by an abrasive coated wire saw. If the stone material needs to be further dimensioned, or if a contoured surface is desired, it can be dimensioned with bonded abrasives (abrasive particles and binder molded into a hardened mass). In this step, there may be several types and grades of bonded abrasives which are utilized. Additionally, surface defects in the stone surface can be removed with abrasive products comprising abrasive particles bonded together in a metal binder, referred to as "metal bonded abrasives," such as those known under the trade designation 3M Flexible Metal Bond "Diamond Abrasives", Grades M250, M125, M74, M40 and M20, commercially available from Minnesota Mining and Manufacturing Company, St. Paul, Minn. ("3M"). Finally, the stone is polished with an abrasive article to a desired surface finish or "gloss." Gloss relates to the surface shininess or luster and involves the ability of the surface to reflect light. The polishing step will generally remove any remaining defects and scratches produced by earlier abrading steps. In the polishing step there may be used a series of abrasive articles with sequentially finer grades. An example of such a product is that known under the trade designation "3M Flexible Resin Bond Diamond Abrasives", Grades R30, R10 and R2, commercially available from 3M.

To achieve a high gloss, the average scratch depth needs to be substantially reduced. If scratch depth is not reduced, light may not be specularly reflected, resulting in a lower gloss. What is desired in the abrasive industry is an efficient method to provide a high gloss on a stone surface.

SUMMARY OF THE INVENTION

In accordance with the present invention, a method of refining stone in which the stone has at least one exposed surface is presented, the method comprising the steps of:

a) bringing into frictional contact an abrasive article to the exposed surface of the stone; and b) refining the exposed surface of the stone with the abrasive article, preferably in the presence of water, wherein the abrasive article comprises a plurality of abrasive particles adhered to a backing (preferably a flexible backing) by a binder, the abrasive particles and cured resin forming a resilient abrasive composite, wherein the binder comprises a cured resin derived from a resin comprising a plurality of unsaturated addition polymerizable units. As used herein the term "units" includes monomers and oligomers. The term "refining" when referring to the method of the invention includes polishing (i.e., increasing gloss), but also includes methods in which gloss is not substantially improved but average scratch depth in the surface is reduced.

A preferred method of refining stone is one in which the stone having at least one exposed surface is polished, the method comprising the steps of:

a) bringing into frictional contact an abrasive article to the exposed surface of the stone; and b) polishing the exposed surface of the stone with the abrasive article in the presence of water, wherein the abrasive article comprises a plurality of abrasive particles adhered to a flexible backing by a binder, the abrasive particles and binder forming a resilient abrasive composite, wherein the binder comprises a resin having polymerized units, the polymerized units having been polymerized by a free radical mechanism.

Another aspect of the invention is drawn toward the abrasive article useful in the method of the invention, the abrasive article comprising abrasive particles adhered to a backing by a binder, the abrasive particles and binder forming a resilient abrasive composite, the binder comprising a cured resin derived from a resin comprising a plurality of unsaturated addition polymerizable units and an effective amount of a plasticizer, with the abrasive particles present in the composite in an amount ranging from about 1 to about 25 (more preferably ranging from about 3 to about 15) weight percent of the weight of the composite. As used herein the term "effective amount" of a plasticizer means that the plasticizer is present in the composite in an amount sufficient to lower the glass transition temperature of the cured resin, preferably by at least 10° C. This effectively makes the composite more resilient during abrading.

One preferred abrasive article comprises a woven polyester backing having first and second major surfaces which is sealed on at least one of its major surfaces with a thermoplastic resin presize coating, preferably a thermoplastic polyester resin. Discrete nodules of abrasive composite are adhered to the presize resin.

As used herein a "resin comprising a plurality of unsaturated addition polymerizable units" polymerizes via a free radical or ionic mechanism at sites of monomer unsaturation (i.e. at —C=C—sites). During the curing or polymerization process, free radicals or ions are generated by exposing the resin (or resin plus initiator, when necessary) to an energy source such as ultraviolet radiation, visible radiation, an electron beam, and the like. Another useful energy source is thermal energy. Resins which are useful in forming abrasive articles useful in the invention preferably include monomers selected from acrylates, acrylamides, and vinyl compounds. One preferred binder is derived from a combination of an oligomeric acrylated urethane resin, a monomeric acrylated urethane resin, a plasticizer, and a suspending agent, the latter useful as a rheology modifier during coating of the binder precursor onto the backing.

Binders useful in the invention are preferably formed from a binder precursor composition which comprises an unsaturated addition polymerizable "resin" and may comprise optional ingredients. As used herein "resin" is a general term denoting monomers, oligomers, and combinations thereof.) After the unsaturated addition polymerizable resin is "cured" (i.e., polymerized), the cured mass is then termed a "binder." Thus it is important to ensure that optional ingredients do not substantially interfere with the curing process, or render the composite hardness outside of the desired range.

The term "refine" means that the average scratch depth of the original stone surface is reduced and/or gloss is increased, measured using standard equipment. one way to measure depth of scratch is with a profilometer that traces the surface of the stone. The refining step will polish the stone surface such that the average scratch depth is reduced, thereby generating a higher gloss.

The term "flexible" when referring to the preferred backing denotes that the abrasive article is able to conform to surface irregularities in the stone, such as corners, seams, engraved lettering, and the like. The term "resilient" when used in reference to the composite means that the composite is capable of deforming along with the backing, and is capable of efficiently polishing stone surfaces to increase the gloss. To meet these preferred properties, it has been discovered that the composite preferably has an average Knoop hardness ("HK") of no more than 15 HK ($kg_f/mm^2$) for refining marble, but at least 1 HK, the HK measured using a 100 gram load. Note that the maximum Knoop hardness may be as high as 20 HK depending on the stone surface. For example, it may be necessary to employ composites having hardness of about 20 HK when refining granite. When the maximum value of 15 HK is used herein this designates marble as the stone. In contrast, cured phenolic resins exhibit hardness values of about 50 HK.

Prior to refining the stone, the stone surface typically has defects or coarse scratches remaining from the physical modification process. During refining, these defects or coarse scratches are reduced in depth or removed and a higher gloss surface is generated. There may be more than one abrasive article used in the refining step, i.e., there may be used a series abrasive articles that employ abrasive particles of different grades. The refining step typically and preferably starts with an abrasive article that has larger average abrasive particle size and progresses through a series of abrasive articles having average abrasive particle size lower than the preceding article. During the refining step, the gloss of the stone surface is increased, preferably to a high gloss (i.e. greater than 60 glossmeter value at 60° incidence angle).

The abrasive articles of the invention unexpectedly are more durable (i.e., have a longer useful life) when used for polishing a variety of stone surfaces.

Further understanding of the invention will become apparent from the following.

DESCRIPTION OF PREFERRED EMBODIMENTS

Figure 1:
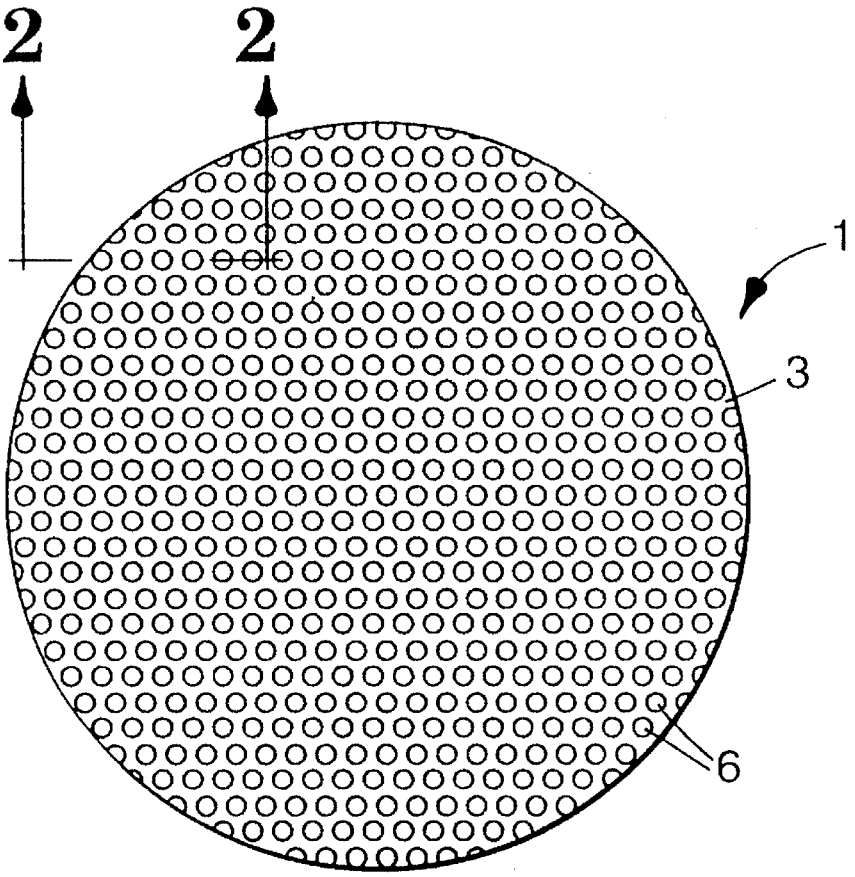
FIG. 1 is a plan view of one preferred abrasive article in accordance with the invention.

This invention pertains to a method of refining (preferably polishing) stone with an abrasive article that comprises a plurality of abrasive particles that are bonded to a backing by means of a binder comprising a cured resin derived from a resin comprising a plurality of unsaturated addition polymerizable units.

The term "stone" of course, is a broad term, and herein includes igneous, sedimentary, metamorphic or hybrid rock. Examples of stone types which may benefit from the method of this invention include granites, limestones (including marble), shale (including slate), sandstones (including quartz) and basalts. Granites are igneous rocks comprised primarily of alkali feldspar, quartz and plagioclase.

The end use of the stone may be in a home or a commercial environment. The stone may be used for decorative purposes or structural purposes. Examples of decorative and/or structural uses include paneling, headstones, monuments, wainscoting, floor tiles (including terrazzo), stair treads, columns, spindles, table tops, fireplace mantles, counter tops, walls, vaults, walkways, patios, sills, floors, steps and the like.

The stone will have at least one surface that is to be polished. The dimensions of the stone can vary, from very small to very large. For instance, the dimension can be from about 0.1 millimeters (such a marble grains in terrazzo) to over tens of meters. Typically, the stone dimensions will range from about 0.1 millimeters to 5 meters. As previously noted, the stone surface may be relatively flat or it may have some contour associated with it. These contours can be in the shape of curves or corners.

Abrasive Articles Useful in Refining Stone

A. Binders

The binder functions to adhere (sometimes referred to herein as "bond") the abrasive particles to each other and to the backing. The hardness of the binder, and thus the hardness of the composite of binder and abrasive particles, is critical to the performance of the inventive abrasive article during refining of the stone surface. Preferred binders are those which result in the composite hardness being less than 15 HK (for polishing marble), more preferably ranging from about 3 to about 9, but in all cases at least about 1 HK. Composites having hardness within these ranges result in an abrasive article that very efficiently refines stone surfaces and generate high gloss on those surfaces. If the composite hardness is too high, then the resulting abrasive article will actually be too efficient and not refine the stone surface, or will not increase gloss. (As used herein "efficient" when referring to abrasion means a high level of stone removal per unit time and a correspondingly low loss of abrasive article, in the same unit of time. The former is typically referred to as "cut" while the latter is referred to as "wear".)

Knoop hardness determinations were performed essentially using the method described in American Society for Testing Materials ("ASTM") C-849, which is incorporated herein by reference. Knoop hardness has units of $kg_f/mm^2$ herein.

"Resins comprising a plurality of unsaturated addition polymerizable units" includes resins in which polymerization is initiated and propagated by either free radicals or ions (including anions or cations), and the terms "polymerizable"

and "polymerized" are meant to include both chain growth and crosslinking reactions. In the present invention, polymerization is initiated by exposing the binder precursor to an energy source (in the presence of an initiator if necessary) such as thermal energy or radiation energy. Examples of suitable radiation energy include particle radiation such as electron beam irradiation and the like, and nonparticle radiation such as, ultraviolet radiation and visible light.

Examples of resins which cure by a free radical mechanism and which are useful in the invention include acrylated urethanes, acrylated epoxies, acrylated polyesters, ethylenically unsaturated compounds, aminoplast derivatives having pendant unsaturated carbonyl groups, isocyanurate derivatives having at least one pendant acrylate group, isocyanate derivatives having at least one pendant acrylate group and mixtures and combinations thereof. The term "acrylated" is meant to include monoacrylated, monomethacrylated, multiacrylated, and multi-methacrylated monomers, oligomers and polymers.

Preferred acrylated urethanes are diacrylate esters of hydroxy-terminated and diisocyanate-extended polyesters or polyethers. The average molecular weight of preferred acrylated urethane oligomer resins ranges from about 300 to about 10,000, more preferably from about 400 to about 7,000. Examples of commercially available acrylated urethanes of this type include those known under the trade designations "Uvithane" 782, "Uvithane" 783, "Uvithane" 788, and "Uvithane" 893 Specialties, Louisville, Ky.).

Examples of preferred acrylated epoxies are diacrylate esters of epoxy resins, such as the diacrylate esters of bisphenol A epoxy resin. Examples of commercially available acrylated epoxies include those known under the trade designations "CMD 3500", "CMD 3600", and "CMD 3700" (available from Radcure Specialties) and "CN103", "CN104", "CN111", "CN112" and "CN114" (available from Sartomer Company).

Examples of preferred polyester acrylates include those known under the trade designations "Photomer" 5007 and "Photomer" 5018 (available from Henkel Corporation).

"Ethylenically unsaturated resins" include both monomeric and polymeric compounds that contain atoms of carbon, hydrogen and oxygen, and optionally, nitrogen and the halogens. Oxygen or nitrogen atoms or both are generally present in ether, ester, urethane, amide, and urea groups. Ethylenically unsaturated resins for use in producing abrasive articles useful in the invention preferably have a molecular weight of less than about 4,000 and are preferably esters made from the reaction of compounds containing aliphatic monohydroxy groups or aliphatic polyhydroxy groups and unsaturated carboxylic acids, such as acrylic acid, methacrylic acid, itaconic acid, crotonic acid, isocrotonic acid, maleic acid, and the like. Representative examples of acrylate resins include isobornyl acrylates, methyl methacrylate, ethyl methacrylate styrene, divinylbenzene, vinyl toluene, ethylene glycol diacrylate, ethylene glycol methacrylate, hexanediol diacrylate, triethylene glycol diacrylate, trimethylolpropane triacrylate, glycerol triacrylate, pentaerythritol triacrylate, pentaerythritol methacrylate, pentaerythritol tetraacrylate and pentaerythritol tetraacrylate. Other ethylenically unsaturated resins include monoallyl, polyallyl, and polymethallyl esters and amides of carboxylic acids, such as diallyl phthalate, diallyl adipate, and N,N'-diallyladipamide. Still other nitrogen containing compounds include tris(2-acryloyloxyethyl)isocyanurate, 1,3,5-tri(2-methyacryloxyethyl)-s-triazine, acrylamide, methylacrylamide, N-methylacrylamide, N,N-dimethylacrylamide, N-vinylpyrrolidone, and N-vinylpiperidone.

Aminoplast resins have at least one pendant alpha, beta-unsaturated carbonyl group per molecule or oligomer. These unsaturated carbonyl groups can be acrylate, methacrylate or acrylamide type groups. Examples of such materials include N-hydroxymethyl-acrylamide, N,N'-oxydimethylenebisacrylamide, ortho and para acrylamidomethylated phenol, acrylamidomethylated phenolic novolac and combinations thereof. These materials are further described in U.S. Pat. No. 4,903,440 and U.S. Ser. No. 07/659,752 (filed Feb. 24, 1991) both incorporated herein by reference.

Isocyanurate derivatives having at least one pendant acrylate group and isocyanate derivatives having at least one pendant acrylate group are further described in U.S. Pat. No. 4,652,274, incorporated herein by reference. One preferred isocyanurate material is a triacrylate of tris(hydroxyethyl) isocyanurate.

It is to be understood that mixtures of the above unsaturated addition polymerizable resins could also be employed.

Some of the free radical curable resins are considered oligomers, while others are considered monomers. Oligomers, as defined in R. B. Seymour & C. E. Carraher, Jr., Polymer Chemistry, 2nd Ed., are very low molecular weight polymers in which the number of repeating units (n) equals 2 to 10. Monomers generally only consist of one unit that does not repeat.

Depending upon how the unsaturated addition polymerizable resin is cured or polymerized, the binder precursor may further comprise a curing agent, (which is also known as a catalyst or initiator). When the curing agent is exposed to the appropriate energy source, it will generate a free radical or ion that will initiate the polymerization process.

Examples of curing agents that when exposed to thermal energy generate a free radical include peroxides, e.g., benzoyl peroxide, azo compounds, benzophenones, and quinones. Examples of curing agents that when exposed to ultraviolet light generate a free radical include but are not limited to those selected from the group consisting of organic peroxides, azo compounds, quinones, benzophenones, nitroso compounds, acryl halides, hydrozones, mercapto compounds, pyrylium compounds, triacrylimidazoles, bisimidazoles, chloroalkytriazines, benzoin ethers, benzil ketals, thioxanthones, and acetophenone derivatives, and mixtures thereof. Examples of curing agents that when exposed to visible radiation generate a free radical can be found in U.S. Pat. No. 4,735,632, incorporated herein by reference.

The binder precursor composition may further comprise a plasticizer which functions to reduce the glass transition temperature of the cured resin, thus rendering the composite more flexible (able to deform with the backing) and resilient (able to deform due to abrasion of a surface). The plasticizer should be compatible with the unsaturated addition polymerizable resin and other optional resins and ingredients such that there is little or no phase separation. Examples of useful plasticizers for use in the invention include polyvinyl chloride, cellulose esters, phthalate, adipate and sebacate esters, polyols, polyols derivatives, tricresyl phosphate, castor oil and the like. The preferred plasticizers are polyol derivatives such as polyethyleneglycol having average molecular weight ranging from about 200 to about 1000, more preferably about 600. The amount of plasticizer is generally less than 30 weight percent, typically less than about 15 weight percent and preferably less than 10 weight percent of the total binder precursor weight.

In addition to the unsaturated addition polymerizable resin, the binder precursor may further comprise from about 5 to about 10 weight percent of an ionically initiated epoxy resin, preferably cationically initiated. Epoxy resins have an oxirane and are polymerized by the ring opening. Useful epoxy resins include monomeric epoxy resins and polymeric epoxy resins. Examples of some preferred epoxy resins include 2,2-bis[4-(2,3-epoxypropoxy)-phenylpropane](diglycidyl ether of bisphenol) and commercially available materials under the trade designation "Epon 828", "Epon 1004" and "Epon 1001F" available from Shell Chemical Co., "DER-331", "DER-332" and "DER-334" available from Dow Chemical Company. Other suitable epoxy resins include cycloaliphatic epoxies such as epoxy resins available from Union Carbide, Danbury CT, under the trade designation "ERL-4221", glycidyl ethers of phenol formaldehyde novolac (e.g., "DEN-431" and "DEN-428" available from Dow Chemical Company). Particularly preferred are blends of unsaturated addition polymerizable resins with other addition polymerizable resins such as those described in U.S. Pat. No. 4,751,138 (Tumey et al.), incorporated by reference herein.

Binder precursors useful in this invention may further comprise optional additives which do not render the hardness of the resulting composite outside of the range of about 1 to about 15 HK (when marble is being polished). For example, fillers (including grinding aids), fibers, lubricants, wetting agents, antistatic agents, surfactants, pigments, dyes, and suspending agents may be used. The amounts of these materials are selected to provide an abrasive composite having the desired hardness so that the article generates high gloss on the stone surface being polished.

Diluents may also be used in the binder precursors. As used herein the term "diluent" denotes a low molecular weight (less than 500) organic material that may or may not decrease the viscosity of the binder precursor to which they are added. Diluents may be reactive with the resin or inert.

Low molecular weight acrylates are one preferred type of reactive diluent. Acrylate reactive diluents preferred for use in the invention typically have a molecular weight ranging from about 100 to about 500, and include isobornyl acrylate, ethylene glycol diacrylate, ethylene glycol dimethacrylate, hexanediol diacrylate, triethylene glycol diacrylate, trimethylolpropane triacrylate, glycerol triacrylate, pentaerythritol triacrylate, pentaerythritol trimethacrylate, pentaerythritol tetraacrylate and pentaerythritol tetramethacrylate. Methyl methacrylate and ethyl methacrylate may also be used.

Other useful reactive diluents include monoallyl, polyallyl, and polymethallyl esters and amides of carboxylic acids (such as diallyl phthalate, diallyl adipate, and N,N-diallyladipamide); tris(2-acryloyloxyethyl)isocyanurate, 1,3,5-tri(2-methacryloxyethyl)-s-triazine, acrylamide, methylacrylamide, N-methylacrylamide, N,N-dimethylacrylamide, N-vinylpyrrolidone, and N-vinylpiperidone.

The binder precursor may further comprise a coupling agent. Coupling agents may function to increase the bond strength between various binder components. Examples of coupling agents suitable for use in this invention include organosilanes, zircoaluminates and titanates. The coupling agent may be added directly to the binder precursor; alternatively, the abrasive particles or filler may be first coated with the coupling agent and then added to the binder precursor.

In some cases it may be preferable to add a suspending agent to the binder precursor composition to prevent the particulate materials such as abrasive particles from settling out of the binder precursor. Suspending agents may also improve or maintain the desired the rheological properties of the binder precursor. Examples of suspending agents useful in the invention are amorphous silica fillers such as that known under the trade description "R-972 Aerosil" commercially available from DeGussa Inc, New York, N.Y., and amorphous silica fillers such as that known under the trade designation "OX-50" also commercially available from DeGussa Inc., which is an amorphous silica having average particle size of 40 millimicrometers and surface area of 50 $m^2/g$.

Binder precursor compositions which are slurries comprising abrasive particles, an unsaturated addition polymerizable resin, and optional ingredients preferably comprise by weight between 60 to 99.9%, preferably between 75 to 99%, more preferably between 85 to 97% resin, and between 0.01 to 40%, preferably between 1 to 25%, more preferably between 3 to 15% abrasive particles. This amount of abrasive particles has been found to provide the desired degree of abrasion to increase the gloss of many stone surfaces.

Particularly preferred binder precursor slurries comprise an oligomeric free radical curable resin, a monomeric free radical curable resin, a plasticizer, abrasive particles and optionally a coupling agent and a suspending agent. In these particularly preferred slurries the slurry comprises by weight between about 15 to 90%, preferably between 25 to 70% oligomeric free radical curable resin, between about 1 to 50%, preferably between 5 to 30% monomeric free radical curable resin, from 0 to 30%, preferably between 1 to 20% plasticizer, from 0 to 20%, preferably between 0.5 to 10% suspending agent and a small weight percentage of a coupling agent. The selection of the amount and type of these materials, as mentioned previously, in the binder precursor slurry preferably results in a binder that has sufficient integrity to be useful as a binder for abrasive particles, but which yields a composite having has a hardness in the desired range.

It may be preferred in some instances to form the abrasive article by use of make and size coatings. In these abrasive article embodiments, a make coating is applied to a backing, the abrasive particles are applied to the backing, the make coating is exposed to conditions to at least partially cure the make coating, and a size coating is applied over the abrasive particles and make coating. The structure is then subjected to conditions sufficient to cure the make and size coatings. Optional presize and supersize coatings may also be applied as known in the art.

B. Backing Materials

Backings serve the function of providing a support for the abrasive composite formed by the combination of binder and abrasive particles. Backings useful in the invention must be capable of adhering to the binder after exposure of binder precursor to curing conditions, and are preferably flexible after said exposure so that the articles used in the inventive method may conform to surface irregularities in the stone.

Examples of typical backings include polymeric film, primed polymeric film, cloth, paper, vulcanized fiber, open mesh fabrics, wovens and nonwovens and combinations thereof. A particularly preferred backing is a woven polyester backing.

The backing may be treated with a thermosetting or thermoplastic resin to reinforce the backing, protect the fibers in the backing, seal the backing, and/or improve the adhesion of the binder to the backing. Examples of typical and preferred thermosetting resins include phenolic resins, aminoplast resins, urethane resins, epoxy resins, ethylenically unsaturated resins, acrylated isocyanurate resins, urea-formaldehyde resins, isocyanurate resins, acrylated urethane resins, acrylated epoxy resins, bismaleimide resins and mixtures thereof. Examples of preferred thermoplastic resins include polyamide resins (e.g. nylon), polyester resins and polyurethane resins (including polyurethaneurea resins). One preferred thermoplastic resin is a polyurethane derived from the reaction product of a polyester polyol and an isocyanate.

C. Abrasive Particles

Abrasive particles useful in the invention preferably have an average particle size ranging from about 0.1 micrometer (small particles) to 300 micrometers (large particles), usually between about 1 micrometer to 30 micrometers. It is preferred that the abrasive particles have a Mohs hardness of at least 8, more preferably at least 9. Examples of abrasive particles suitable for use in the invention include fused aluminum oxide, ceramic aluminum oxide, heated treated aluminum oxide, silicon carbide, alumina zirconia, iron oxide, diamond (natural and synthetic), ceria, cubic boron nitride, garnet and combinations thereof. The term "abrasive particles" is meant to include single abrasive particles bonded together by a binder to form an abrasive agglomerate. Abrasive agglomerates are further described in U.S. Pat. Nos. 4,311,489; 4,652,275 and 4,799,939, incorporated herein by reference. The abrasive particle may further comprise a surface treatment or coating, such as a coupling agent or ceramic coating.

D. Preferred Embodiments

Figure 2:
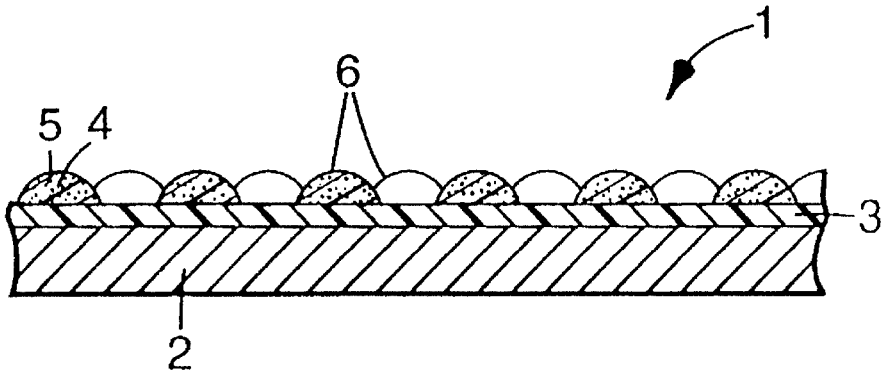
FIG. 2 is an enlarged cross section taken along the line 2—2 of the abrasive article illustrated in FIG. 1.

Referring now to the drawing figures, one preferred embodiment of an abrasive article in accordance with the invention is illustrated in FIGS. 1 and 2 in plan and enlarged sectional views, respectively. A plurality of such articles are typically and preferably attached via hook and loop fasteners (not shown) to conventional floor maintenance machines. Article 1 has a woven polyester backing 2 which is sealed on one major surface with a thermoplastic polyester presize coating 3. To the hardened presize coating 3 a slurry is applied through a screen (not shown), the slurry comprising abrasive particles and unsaturated addition polymerizable resin to form a plurality of raised nodules 6 of composite on the presize coating 3. The nodules of composite may vary in shape and size, and may be distributed randomly or uniformly on the presize coating, according to the desires of the user. Preferably, nodules 6 are appear circular from a plan view, all nodules having the same diameter. Nodules 6 preferably have height ranging from about 1 mm to about 30 mm. The spacing between nodules 6 and the height and diameter of the nodules may vary from nodule to nodule within a single article and may vary from article to article, but are selected to optimize the increase in gloss on the stone surface being refined. Preferably between 10 to 90%, generally between 20 to 70% of the surface area of the backing will be covered with the nodules. In some embodiments, such as that illustrated in FIG. 8 (discussed below), it may be desired that the composite cover up to 95 percent of the surface of the article. During polishing, the areas free from the composite allow for the stone swarf to be removed from the abrading interface.

Figure 3:
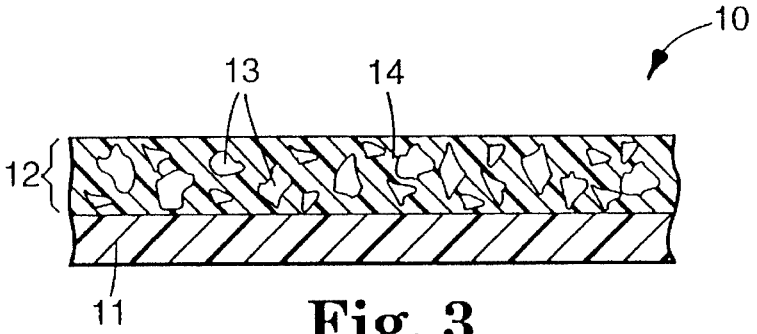
FIG. 3 is an enlarged sectional view of a second abrasive article embodiment in accordance with the invention.

Referring now to FIG. 3, another abrasive article embodiment 10 is illustrated in cross section, commonly referred to as a lapping abrasive article. Articles of this type comprise a backing 11 (preferably a woven polyester) and an abrasive composite 12 which preferably completely covers one major surface of backing 11. Abrasive composite 12 comprises a plurality of abrasive particles 13 and a binder 14, preferably a plasticized acrylic binder.

To make a lapping coated abrasive as illustrated in FIG. 3, an unsaturated addition polymerizable resin, abrasive particles, and optional ingredients are mixed together to form a slurry. The slurry is then coated onto the backing via roll coating, spray coating, or the like. After the resin in the binder precursor is cured, the slurry becomes an abrasive composite.

Figure 4:
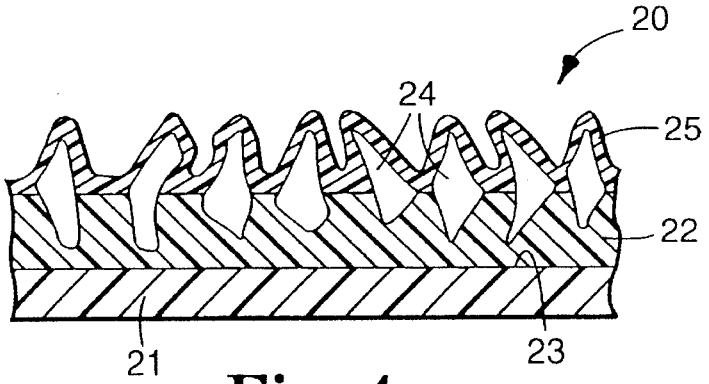
FIG. 4 is an enlarged sectional view of a third abrasive article embodiment in accordance with the invention.

Referring to FIG. 4, a cross section of an abrasive article 20 is illustrated, commonly referred to as a coated abrasive, comprising a backing 21 having a first binder 22, commonly referred to as a make coating, present over the front surface 23 of the backing 21. Into the make coating 22 are embedded a plurality of abrasive particles 24. Over the abrasive particles 24 and make coating 22 is coated a second binder 25, commonly referred to as a size coating, which reinforces the abrasive particles.

Figure 5:
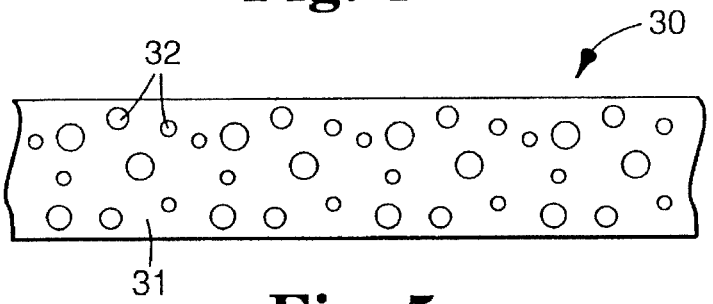
FIG. 5 is a plan view of a fourth abrasive article embodiment in accordance with the invention.

Referring to FIG. 5, a plan view of a lapping abrasive article 30 is illustrated, the article being in the form of a continuous belt. The article has a dot-like pattern of abrasive composites 32 and areas free of the abrasive composite 31. The areas free of the abrasive composite typically expose the backing, or a presize coated onto the backing. It is within the scope of this invention that the dots could be squares, triangles, diamonds, polygons, octagons or any other geometric shape. As with the embodiment illustrated in FIGS. 1 and 2, preferably between 10 to 90%, generally between 20 to 70% of the surface area of the backing will be covered with the abrasive composites.

Figure 6:
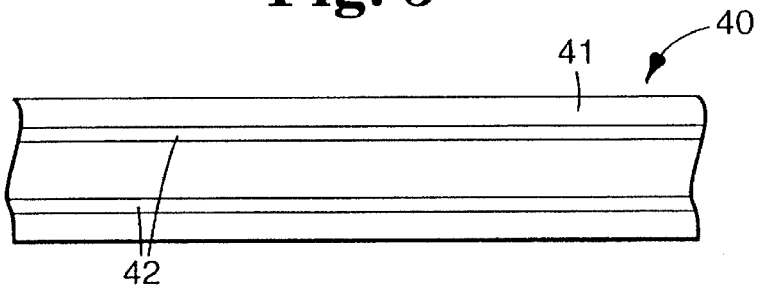
FIG. 6 is a plan view of a fifth abrasive article embodiment in accordance with the invention.

Referring to FIG. 6, another lapping abrasive article 40 in the form of a continuous belt is illustrated in plan view having two continuous longitudinal rows of abrasive composite 42 and areas of the backing 41 free of the abrasive composite. It is within the scope of this invention that the rows could be straight, sinusoidal, parallel, or non-parallel. Preferably between 10 to 90%, generally between 20 to 70% of the surface area of the backing will be covered with the abrasive composites. As with the embodiment illustrated in FIG. 5, a presize coating, rather than the backing, may be exposed.

Figure 7:
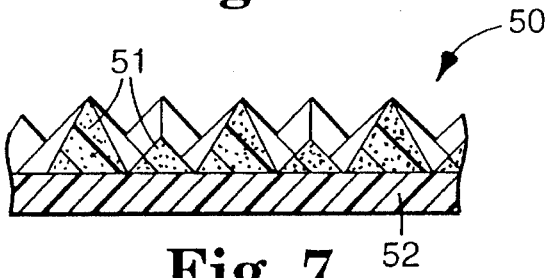
FIG. 7 is an enlarged sectional view of another abrasive article embodiment in accordance with the invention.

Referring to FIG. 7, a lapping abrasive article 50 is illustrated in cross section comprising a plurality of pyramids of equal height butted up against one another (i.e., preferably no backing is exposed, although this is not a requirement). It will be apparent that the pyramids could vary in height on a single abrasive article. The pyramids are comprised of abrasive particles and binder, and may be formed using the methods described in Pieper, U.S. Pat. No. 5,152,917, incorporated by reference herein.

Figure 8:
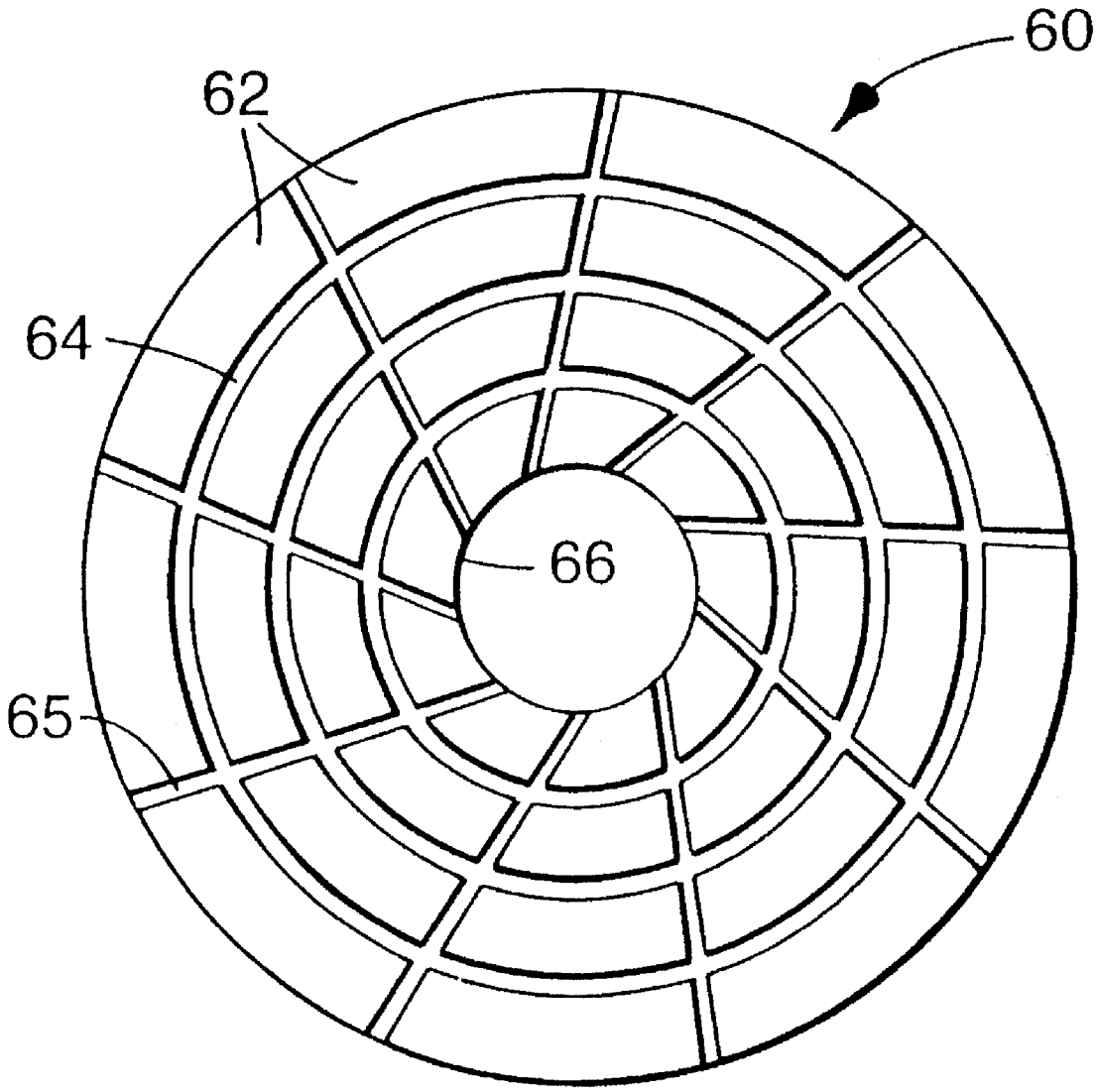
FIG. 8 is a plan view of another preferred abrasive article in accordance with the invention.

Referring now to FIG. 8, illustrated in plan view is another abrasive article embodiment 60. The abrasive composite in this embodiment is present on one major surface of a backing (not shown) as a plurality of discrete areas 62 separated by channels 64 and 65. Channels 64 and 65 allow water or other fluid fed through hole 66 to wash away swarf during a stone refining process. It should be apparent that discrete areas of abrasive composite 62 may take any of a number of shapes. The particular pattern illustrated in FIG. 8, when used on discs having diameter of about 10 cm attached to a hand-held rotary tool, has been determined to produce high gloss stone surfaces when used in the presence of a water flood. For a 10 cm diameter disc, channels 64 and 65 are typically about 0.25 cm wide and about the depth, with the optimal width and depth easily determined by the skilled artisan once a stone surface, down force, binder, backing material, and abrasive particles have been selected. A preferred abrasive article such as that illustrated in FIG. 8 has a woven polyester backing, sealed with a polyester presize coating, over which is coated via a screen or other means a binder precursor slurry as above described for the embodiment illustrated in FIG. 1.

Methods of Polishing Stone

Prior to polishing in accordance with the method of the invention, the stone will typically be subjected to a variety of physical processes (including abrading) to achieve the desired dimensions of the stone. These previous processes may leave scratches or expose defects in the stone surface which typically result in a dull appearing surface. This invention pertains to a method of polishing the stone surface to remove enough of the scratch depth and defects to result in a stone surface having a high gloss value. "Gloss" pertains to the stone surface shininess or luster. When light is shone on a stone surface, the light will be refracted or scattered by the scratches in the surface. If the scratches are substantially removed, or if the depth of scratch is substantially low, then the light will be reflected, thus resulting in a high gloss surface.

There is typically more than one "polishing" or "refining" article used in the refining step of the method of the invention. In general, one abrasive article having a given average abrasive particle size is not sufficient to generate a very high gloss surface. Rather a sequence of abrasive articles is employed during which the average scratch depth is continually reduced. The first abrasive article employed will typically contain abrasive particles that have larger particle size. As the polishing continues, the abrasive particle size in the abrasive article employed is continually reduced by the user by changing the abrasive article. This results in a gradual reduction in scratch depth. The number of abrasive articles, time for polishing, types of abrasive particles and sizes of abrasive particles will depend upon various factors such as the stone surface being polished, the scratches and/or defects present in the stone prior to polishing and the desired level of gloss.

It is preferred to polish the stone in the presence of a liquid. The liquid has several advantages associated with it. It inhibits heat build up during polishing and removes the swarf away from the polishing interface. "Swarf" is the term used to describe the actual stone debris that is abraded away by the abrasive article. In some instances, the stone swarf can damage the surface of the stone being polished. Thus it is desirable to remove the swarf from the interface. Polishing in the presence of a liquid also results in a finer finish on the stone surface. This liquid can be water, an organic lubricant, a detergent, a coolant or combinations thereof. The liquid may further contain additives to enhance polishing. Water is generally the preferred liquid.

During polishing the abrasive article moves relative to the stone surface and is forced downward onto the stone surface preferably the force ranging from about 0.35 to about 7.0 $g/mm^2$, more preferably between about 0.7 to about 3.5 $g/mm^2$. If too high of a down force is used, then the abrasive article may not refine the scratch depth and in some instances may increase the scratch depth. Also, the abrasive article may wear excessively if the down force is too high. If too low down force is used, the abrasive article may not effectively refine the scratch depth and generate the desired level of gloss.

As stated, the stone or the abrasive article or both will move relative to the other during the refining step. This movement can be rotary motion, a random motion, or linear motion. Rotary motion can be generated by attaching an abrasive disc to a rotary tool. The stone surface and abrasive article may rotate in the same direction or opposite directions, but if in the same direction, at different rotational speeds. For hand-held tools the tool operating rpm may range up to 4000 rpm, while typical floor machines may operate anywhere from about 50 to 1000 rpm depending on the abrasive article employed. For example, when three discs such as illustrated in FIGS. 1 and 2 are attached to a conventional floor maintenance machine, each disc being about 20 cm in diameter and equally spaced apart from each other, the machine may have a rotational speed of about 800 rpm. Lapping machines typically operate at 25 to 500 rpm. A random orbital motion can be generated by a random orbital tool, and linear motion can be generated by a continuous abrasive belt. The relative movement between stone and abrasive article may also depend on the dimensions of the stone. If the stone is relatively large, it may be preferred to move the abrasive article during polishing while the stone is held stationary.

Methods of Making Abrasive Articles

The following procedure describes a preferred method of making a lapping abrasive article useful in the method of the invention in which there is not a pattern associated with the abrasive composite. First, a slurry is prepared by mixing together abrasive particles, an unsaturated addition polymerizable resin, and optional ingredients. Any conventional technique can be employed to mix these materials. Preferably, the abrasive particles should be uniformly distributed in the binder precursor. After the slurry is prepared, it is applied to one side of a backing by any conventional means such spray coating, roll coating, die coating or knife coating. Next, the slurry is exposed to an energy source to cure or polymerize the unsaturated addition polymerizable resin, and other optional resins in the slurry. In some instances it is preferred to polymerize the resins in an inert atmosphere to prevent oxygen inhibition of the addition polymerizable resin, if it is free radically initiated free radicals.

The energy source can be heat, radiation energy or combination of energy sources. Examples of radiation energy include electron beam, ultraviolet light or visible light. For thermal energy, temperatures will typically and preferably range from about 50° C. to about 250° C. for exposure times ranging from about 15 minutes to about 16 hours. The choice in curing conditions will depend primarily on the resin chemistry and backing type and thickness selected. Electron beam radiation, which is also known as ionizing radiation, can be used at an energy level of about 0.1 to about 10 Mrad, preferably at an energy level of about 1 to about 10 Mrad. Ultraviolet radiation refers to non-particulate radiation having a wavelength ranging from about 200 to about 400 nanometers, preferably ranging from about 250 to 400 nanometers. Visible radiation refers to non-particulate radiation having a wavelength ranging from about 400 to about 800 nanometers, preferably in the ranging from about 400 to about 550 nanometers. The time the slurry is exposed to the ultraviolet or visible light can range from about 1 to 500 seconds depending on the resin type and thickness and intensity of the radiation. For higher radiation intensities, shorter exposure times will be required, assuming the same binders, backing, and the like.

There are several methods to make a lapping abrasive article that is patterned. Examples of useful methods are disclosed in U.S. Pat. Nos. 3,605,349; 4,773,920; 4,930,266; 5,014,468; 5,015,266; 5,092,910. A preferred method is to force the slurry though a screen (corresponding to the desired pattern) and onto to the backing. The slurry is then exposed to an energy source to polymerize the resins in the slurry.

A method of making a patterned lapping abrasive such as that illustrated in cross section in FIG. 7 is described in U.S. Pat. No. 5,152,917 incorporated by reference herein.

One useful procedure for making a coated abrasive article such as that illustrated in FIG. 4 useful in the method of the invention is now described. A make coating precursor is applied to the front side of the backing by any conventional technique such as spray coating, roll coating, die coating, powder coating, hot melt coating or knife coating. The abrasive particles are projected into the make coating precursor either by drop coating or electrostatic coating. The make coating is at least partially cured by exposing the make coating to an energy source, such as those energy sources described above. Then a size coating precursor is applied over the abrasive particles by any conventional technique. The size coating precursor and optionally the make coating precursor are fully cured by exposing them to an energy source. The resulting coated abrasive may be, and preferably is, flexed prior to use. "Flexing" of abrasive articles, in particular coated abrasive articles, is a term of art in the abrasives industry which means the coated abrasive sheet is passed over a 90 degree bend to uniformly crack the binder.

In order to manufacture a coated abrasive such as that illustrated in the plan views of FIGS. 5 and 6 having a pattern, the make coating can be applied to the backing in a pattern. For instance the make coating can be applied through a stencil or rotogravure coating. Alternatively, the make coating may be applied to fully cover the backing and the abrasive particles applied in a pattern. For instance, the abrasive particles may be coated through a screen or stencil.

The following Test Methods and non-limiting Examples will further illustrate the invention. All parts, percentages, ratios, and the like, in the Examples are by weight unless otherwise indicated.

Test Methods

Gloss Measurements

The following general procedure was used to measure the gloss of the marble test specimen. The marble was first dried to remove any residual water or swarf. The glossmeter used was known under the trade designation "Micro-Tri-Gloss" Catalog No. 4525 commercially available from BYK Gardner Inc. of Silverspring, Md. The 20° and 60° glossmeter geometry gloss measurements were made after abrading with the articles described in the Examples. The gloss value was an average of four readings.

Test method ASTM D-523 was followed for determining specular gloss values. Note that "60° glossmeter geometry gloss" value (i.e., incident light reflected from the test surface at incident angle measured 60° from vertical) related to the "shininess" of the surface and correlates to the appearance of the floor about 3 meters in front of the observer. A "20° glossmeter geometry gloss" value relates to the depth of the reflection and correlates to the appearance of the floor about 60 cm in front of the observer. A reading off a glossmeter is an indexed value, with a value of "100" given to the glossmeter reading (from any angle) from a highly polished, plane, black glass with a refractive index of 1.567 for the sodium D line. The incident beam is supplied by the tester itself. A value of 0 is no or very low gloss, while "high gloss" at 60° incidence angle geometry is about 60 or greater (or 30 or greater at 20° incidence angle geometry), which are preferred.

Marble Polishing Test Procedure I

The following test procedure simulated marble polishing. There were two parts to the test machine. The base unit was a polisher known under the trade designation "Ecomet 4" Variable Speed Grinder-Polisher commercially available from Buehler Ltd., Lake Bluff, Ill., which had a circular, horizontal base plate which could be rotated at various speeds. Located horizontally over the base unit was a head unit which held six abrasive discs, each 3.8 cm in diameter, by hook and loop fasteners, the backing of the abrasive disc serving as the loop fastener. The head unit included a rotational power drive known under the trade designation "Automet 2" Power Head, also commercially available from Buehler Ltd. A 28 cm diameter Cream Marfil marble disc that was about 1 cm in thickness was adhered to the flat horizontal circular plate of the base unit by a cured epoxy adhesive. During polishing, the head unit containing the abrasive discs was brought into contact with the marble disc to be tested. The head unit and circular plate of the base unit rotated in a counter motion relative to one another during polishing. The marble disc rotated about 500 rpm, while the head unit rotated at about 30 rpm. The polishing was done wet, with water directed to the center of the marble disc. The polishing time was 30 seconds and the down force applied by the head unit onto the marble disc was about 7 kg during contact by the abrasive discs. After the 30 second polishing time, the head unit was raised and the marble disc was wiped clean with a paper towel. Then four gloss measurements were recorded.

Prior to polishing with the refining discs, the marble was roughened for 30 seconds with flexible metal bond diamond abrasive discs known under the trade designation "M40" commercially available from 3M, for 30 seconds.

Marble Polishing Test Procedure II

This test simulated a marble floor polishing operation. Four different marble tiles were tested: Verde Jade Dark hereinafter referred to as "green marble"; White Carrera hereinafter referred to as "white marble"; Perlato hereinafter referred to as "beige marble" and Negro Marquina hereinafter referred to as "black marble". The marble tiles were 30.5 cm by 30.5 cm square and bonded to an aluminum plate. Twelve square abrasive articles (5 cm×5 cm) were adhered to the rotatable portion of a floor polishing machine known under the trade designation "CIMEX" by means of hook and loop attachment systems as mentioned in Marble Polishing Procedure I. The polishing was done under a water flood. The down force exerted on the marble tile by the machine and abrasive articles was about 33 kg.

Prior to polishing, the marble tiles were abraded sequentially with the following flexible metal bond diamond abrasive grades available from 3M: "M250", "M125", "M74" and "M40", in which the number designates the grade of abrasive particles in the abrasive article. The abrading endpoint for each product was when an even surface had occurred by visual inspection. Prior to polishing with the methods and articles of the invention these metal bonded abrasive articles produced the following gloss listed in Table 1.

TABLE 1

| | GLOSS VALUES | |
|---|---|---|
| Marble type | 20° | 60° |
| green | 0.2 | 1.7 |
| white | 1.0 | 3.3 |
| beige | 0.9 | 3.8 |
| black | 0.2 | 1.7 |

These gloss values were the base line values for the Examples which follow.

Materials Description

UAR is an acrylated urethane resin commercially available from Morton Thiokol of Trenton, N.J., under the trade designation "Uvithane" 893;

AER is an acrylated epoxy resin commercially available from Radcure Specialties, Inc., of Louisville, Ky., under the trade designation "Ebercryl" 3500;

PAR is a polyester acrylate resin commercially available from Henkel Corp., Gulph Mills, Pa., under the trade designation "Photomer" 5007;

ER is a epoxy resin commercially available from Union Carbide, Danbury Conn., under the trade designation "ERL-4221";

PETA is a pentaerythritol tri- and tetra-acrylate commercially available from Sartomer of Exton, Pa;

IBA is isobornylacrylate commercially available from Sartomer Company;

HDODA is 1,6-hexanedioldiacrylate commercially available from Sartomer Company;

PEG is polyethylene glycol (molecular weight 600) commercially available from Union Carbide of Danbury, Conn., under the trade designation "Carbowax";

PH1 is a photoinitiator 2-benzyl-2-N,N-dimethylamino-1-(4-morpholinophenyl-1-butanone) commercially available from Ciba Geigy Corporation under the trade designation "Irgacure" 369;

PH2 is a photoinitiator, cyclopentadienyl iron (II) xylene antimony hexafluoride;

ASF is an amorphous silica filler commercially available from DeGussa Inc. of New York, N.Y. under the trade designation "R972";

CAl is a amino silane coupling agent (gamma-methacryloxypropyltrimethoxy silane) commercially available from Union Carbide Corporation of Danbury, Conn., under the trade designation "A-174";

I33 is a wetting agent commercially available from Interstab Chemicals, new Brunswick, N.J., under the trade designation "Interwet" 33; and WAO is white fused aluminum oxide

EXAMPLES 1 AND 2

Examples 1 and 2 were made according to the following procedure. The backing for these examples was a woven cotton/polyester fabric that contained a thermoplastic polyurethane presize known under the trade designation "K2 Adhesive", and available from Unitherm, Inc., Cincinnati, Ohio. This particular polyurethane presize is derived from the reaction product of a polyester polyol and a diisocyanate, although this is not known to be critical to the invention. A slurry was prepared by thoroughly mixing abrasive particles and addition polymerizable resin. The resulting slurry was forced by spatula through a stainless steel screen that had circular openings that were approximately 2 mm in diameter onto the backing. The resulting material was exposed to one Fusion Systems visible light which operated at 120 Watts/cm with an exposure of about 3 meters/minute. This exposure initiated the polymerization of the addition polymerizable resin to form a lapping abrasive article.

For Example 1, the slurry consisted of 62.2 parts UAR, 4.2 parts PETA, 8.4 parts IBA, 8.4 parts PEG, 0.84 part PH1, 0.1 part carbon black pigment, 10 parts synthetic diamond that had average particle size of 15 micrometers, 4.7 parts of ASF and 1.2 part CAl. For Example 2, the slurry consisted of 52.9 parts UAR, 20.7 parts HDODA, 8.3 parts IBA, 0.83 part PH1, 0.2 part iron oxide pigment, 10 parts synthetic diamond that had average particle size of 3 micrometers, 6.0 parts of ASF and 1.2 part CA1.

The abrasive article of Example 1 was tested according to Test Procedure II for 30 seconds for each marble square and the 20° and 60° gloss was measured. These gloss values can be found in Table 2.

TABLE 2

| 30 SECOND GLOSS VALUES FOR EXAMPLE 1 | | |
|---|---|---|
| Marble type | 20° | 60° |
| green | 14.7 | 40.0 |
| white | 44.9 | 70.6 |
| beige | 13.3 | 35.2 |
| black | 34.0 | 59.4 |

It can be seen that polishing for only 30 seconds on the 30.5 cm marble square with the abrasive article of the invention dramatically improved the resulting gloss compared with the base line gloss values of Table 1.

Next, the same marble tiles from Table 2 were polished for an additional 30 seconds and the gloss values remeasured. These gloss values can be found in Table 3.

TABLE 3

| 60 SECOND GLOSS VALUES FOR EXAMPLE 1 | | |
|---|---|---|
| Marble type | 20° | 60° |
| green | 15.8 | 42.2 |
| white | 46.9 | 74.0 |
| beige | 30.8 | 57.5 |
| black | 31.7 | 59.8 |

The abrasive article of Example 2 was tested according to Test Procedure II for 30 seconds on 30.5 cm marble squares and the resulting gloss was measured. These gloss values can be found in Table 4.

TABLE 4

| 30 SECOND GLOSS VALUES FOR EXAMPLE 2 | | |
|---|---|---|
| Marble type | 20° | 60° |
| green | 33.4 | 56.4 |
| white | 93.0 | 100.4 |
| beige | 68.3 | 83.2 |
| black | 65.8 | 82.8 |

It can be seen that polishing for only 30 seconds on the 30.5 cm marble square with the abrasive article of the invention dramatically improved the resulting gloss when compared with the gloss values listed in Table 3.

Next, the same marble tiles from Table 4 were polished for an additional 30 seconds on the 30.5 cm marble square and the gloss values measured. These gloss values can be found in Table 5.

TABLE 5

| 60 SECOND GLOSS VALUES FOR EXAMPLE 2 | | |
|---|---|---|
| Marble type | 20° | 60° |
| green | 42.5 | 63.9 |
| white | 92.8 | 100.8 |
| beige | 79.5 | 92.4 |
| black | 76.3 | 90.8 |

Next, the same marble tiles from Table 5 were polished for an additional 30 seconds and the gloss values were remeasured. These gloss values can be found in Table 6.

TABLE 6

| 90 SECOND GLOSS VALUES FOR EXAMPLE 2 | | |
|---|---|---|
| Marble type | 20° | 60° |
| green | 48.8 | 68.8 |
| white | 93.6 | 101.7 |
| beige | 72.0 | 87.9 |
| black | 76.8 | 90.1 |

The gloss measurements were made on commercially available marble tiles and these values can be found in Table 7. The marble squares were purchased from Drake Marble Co., St. Paul, Minn.

TABLE 7

| GLOSS VALUES OF COMMERCIALLY AVAILABLE MARBLE TILES | | |
|---|---|---|
| Marble type | 20° | 60° |
| green | 44.3 | 67.9 |
| white | 79.1 | 92.9 |
| beige | 79.1 | 93.2 |
| black | 92.1 | 101.8 |

EXAMPLES 3 THROUGH 5

The abrasive articles for Examples 3 through 5 were made in the same manner as Examples 1 and 2 except that different slurries were utilized. The slurry of Example 3 consisted of 62.3 parts UAR, 4.2 parts PETA, 8.4 parts IBA, 8.4 parts PEG, 0.84 part PH1, 5 parts synthetic diamond that had average particle size of 15 micrometers, 5 parts of WAO that had average particle size of 15 micrometers, 4.7 parts of ASF and 1.2 part CA1. The slurry of Example 4 consisted of 62.3 parts EAR, 4.2 parts PETA, 8.4 parts IBA, 8.4 parts PEG, 0.84 part PH1, 5 parts synthetic diamond that had average particle size of 15 micrometers, 5 parts of WAO that had average particle size of 15 micrometers, 4.7 parts of ASF and 1.2 part CA1. The slurry of Example 5 consisted of 53.3 parts PAR, 12.1 parts PETA, 8.4 parts IBA, 8.4 parts PEG, 0.8 part PH1, 5 parts synthetic diamond that had average particle size of 15 micrometers, 5 parts of WAO that had average particle size of 15 micrometers, 5.8 parts of ASF and 1.2 part CA1.

The abrasive articles were tested according to Test Procedure I and the results can be found in Table 8. The gloss values were measured prior to polishing, and after 30, 60, 90 and 120 seconds of polishing.

TABLE 8

| TEST PROCEDURE I | | | | | | |
|---|---|---|---|---|---|---|
| | Example 3 | | Example 4 | | Example 5 | |
| Time | 20° | 60° | 20° | 60° | 20° | 60° |
| prior | 1.2 | 5.4 | 1.0 | 3.9 | 1.0 | 4.3 |
| 30 | 6.7 | 25.4 | 7.0 | 62.6 | 5.7 | 30.3 |
| 60 | 19.0 | 46.8 | 17.9 | 46.7 | 9.3 | 40.5 |
| 90 | 22.7 | 52.2 | 20.8 | 51.2 | 12.3 | 47.0 |
| 120 | 22.7 | 52.9 | 21.8 | 52.6 | 13.6 | 50.2 |

EXAMPLES 6 and 7

Examples 6 and 7 were made according to the following procedure. The backing for these examples was the same as Example 1. A slurry was prepared by thoroughly mixing the abrasive particles and other ingredients. The resulting slurry was forced with a spatula through a stainless steel screen that had circular openings that were approximately 2 mm in diameter and onto the backing. The resulting material was exposed to one Fusion Systems visible light which operated at 240 Watts/cm. An exposure of about 3 meters/minute was used. Next, the material was heated for about 20 minutes at 175° C.

For Example 6, the slurry consisted of 61.4 parts UAR, 4.2 parts PETA, 8.4 parts IBA, 8.4 parts ER, 0.8 part PH1, 0.4 part PH2, 6 parts PEG, 0.3 part red pigment, 0.1 part I33 wetting agent, 5 parts synthetic diamond that had average particle size of 15 micrometers and 5 parts of ASF. For Example 7, the slurry consisted of by weight 56.94 parts UAR, 13.5 parts HDODA, 9 parts IBA, 9 parts ER, 0.8 part PH1, 0.4 part PH2, 6 parts PEG, 0.3 part red pigment, 0.1 part I33 wetting agent, 5 parts synthetic diamond that had average particle size of 3 micrometers and 5 parts of ASF.

The abrasive articles were tested according to Test Procedure I except that the marble disc was Negro Marquina marble. The marble was first polished with Example 6 for 120 seconds, with gloss measurements taken prior to polishing and at 60 and 120 seconds. After polishing with the abrasive article of Example 6, the marble was polished with the abrasive article of Example 7. Gloss measurements were taken after 30, 60, 90 and 120 seconds of polishing. The test results can be found in Table 9.

TABLE 9

| TEST PROCEUDRE I | | | | |
|---|---|---|---|---|
| | Example 6 | | Example 7 | |
| Time | 20° | 60° | 20° | 60° |
| prior | 0.4 | 5.0 | 26.6 | 51.9 |
| 30 | ** | ** | 81.4 | 91.9 |
| 60 | 25.3 | 51.0 | 90.6 | 97.6 |
| 90 | ** | ** | 92.6 | 99.1 |
| 120 | 26.6 | 51.9 | 94.2 | 100.0 |

**not measured

Comparative Example A

Comparative Example A was a commercially available abrasive disc from 3M sold under the trade designation "R30 Flexible Diamond Discs" designed for polishing marble. This disc contained diamond abrasive particles that had an average particle size of 15 micrometers dispersed in an epoxy binder devoid of addition polymerized resin, the diamond and binder attached to a woven polyester backing which had a thermoplastic polyester presize.

A modified Test Procedure I was used in this set of examples to determine the life of the abrasive discs. The head unit contained two flexible metal bond diamond discs commercially available from 3M under the trade designation "M40", two Example 1 abrasive discs and two Comparative Example A discs. The discs were alternated in the head unit. After every 30 seconds of polishing, the discs were checked for wear. If a disc was worn, it was replaced with a new disc of the same type. During testing the metal bond diamond discs did not wear out. There were four Comparative Example A for every Example 1 disc that was worn. Thus the effective life of the Example 1 disc was approximately four times that of Comparative Example A.

Various modifications and alterations of this invention will become apparent to those skilled in the art without departing from the scope and spirit of this invention, and it should be understood that this invention is not to be unduly limited to the illustrative embodiments set forth herein.

What is claimed is:

1. An abrasive article suitable for refining stone comprising a backing and a resilient composite comprising a binder and abrasive particles, the abrasive particles adhered to the backing to the binder, the binder comprising a cured resin, said resin comprising unsaturated addition polymerizable units and an effective amount of a plasticizer, the abrasive particles being present in amount ranging from about 1 to about 25 weight percent of the weight of binder and abrasive particles, and the resilient composite having a Knoop hardness of greater than 1 and no more than 20.

2. An abrasive article in accordance with claim 1 wherein the resin comprising addition polymerizable units comprises monomers selected from the group consisting of acrylates, acrylamides, and vinyl compounds.

3. An abrasive article in accordance with claim 1 wherein the resin comprising addition polymerizable units includes ionically initiated epoxy units.

4. An abrasive article in accordance with claim 1 wherein the abrasive particles are present in the composite in an amount ranging from about 3 to about 15 weight percent.

5. An abrasive article in accordance with claim 1 wherein said backing comprises a woven backing having a first and a second major surface, at least one of said first and second major surfaces being substantially sealed with a thermoplastic resin presize coating, said composite adhered to said presize coating.

6. An abrasive article in accordance with claim 5 wherein said woven backing comprises polyester fibers.

7. An abrasive article in accordance with claim 6 wherein said thermoplastic resin presize coating is a polyester resin.

8. An abrasive article in accordance with claim 1 wherein said composite is comprised of a plurality of discrete nodules.

9. An abrasive article in accordance with claim 5 wherein said composite comprised of a plurality of discrete nodules.

10. An abrasive article in accordance with claim 7 wherein said composite is comprised of a plurality of discrete nodules.

11. An abrasive article in accordance with claim 1 wherein said composite is comprised of a plurality of discrete areas separated by channels.

12. An abrasive article in accordance with claim 1 wherein said plasticizer is selected from the group consisting of polyvinyl chloride, cellulose esters, phthalate esters, adipate esters, sebacate esters, tricresyl phosphate, polyols and castor oil.

13. An abrasive article in accordance with claim 12 wherein said polyol is a polymer having polymerized ethylene glycol units.

14. An abrasive article in accordance with claim 13 wherein said polyol comprises polymerized ethylene glycol units having a molecular weight ranging from about 200 to about 1000.

15. An abrasive article in accordance with claim 1 wherein said composite has a Knoop hardness of at most 15 but at least 1.

16. An abrasive article in accordance with claim 7 wherein said composite has a Knoop hardness of at most 15 but at least 1.

17. An abrasive article suitable for refining stone comprising an abrasive composite bonded to a backing wherein the abrasive composite has a Knoop hardness less than 15 but at least 1, and wherein the abrasive composite comprises:

a plurality of abrasive particles dispersed in a binder, said binder comprising a cured resin and an effective amount of a plasticizer, said resin comprising a plurality of unsaturated addition polymerizable units.

18. An abrasive article according to claim 17 wherein the abrasive composite Knoop hardness ranges from about 3 to about 9.

19. An abrasive article according to claim 17 wherein the resin is selected from the group consisting of acrylated urethanes, acrylated epoxies, acrylated polyesters, ethylenically unsaturated compounds, aminoplast derivatives having pendant unsaturated carbonyl groups, isocyanurate derivatives having at least one pendant acrylate group, isocyanate derivatives having at least one pendant acrylate group and combinations thereof.

20. An abrasive article according to claim 17 wherein the abrasive composite further comprises a plasticizer.

21. An abrasive article according to claim 20 wherein the plasticizer is a polyol derivative.

22. An abrasive article according to claim 17 wherein the abrasive composite has a patterned surface.

23. An abrasive article comprising an abrasive composite bonded to a backing wherein the abrasive composite comprises a plurality of abrasive particles dispersed in a binder, said binder comprising a cured resin, said resin comprising a plurality of unsaturated addition polymerizable units and a polyol derivative plasticizer dispersed in said binder, the abrasive composition having Knoop hardness of greater than 1 and no more than 20.

24. An abrasive article according to claim 23 wherein the polyol derivative plasticizer is polyethyleneglycol.

25. An abrasive article according to claim 23 wherein the abrasive composite has a patterned surface.

26. An abrasive article comprising:

a flexible backing and a resilient composite, said composite comprising from about 1 to about 25 wt-% abrasive particles, a resilient binder, and from about 1 to about 20 wt-% of a plasticizer, the abrasive particles adhered to the flexible backing by the resilient binder, the binder comprising a cured resin, said resin comprising units polymerizable by a free radical mechanism, and the resilient composite having a Knoop hardness of greater than 1 and no more than 20.

27. An abrasive article in accordance with claim 26 wherein said composite is comprised of a plurality of discrete nodules.

28. An abrasive article in accordance with claim 26 wherein said composite is comprised of a plurality of discrete areas separated by channels.

* * * * *